United States Patent [19]

Anastos

[11] Patent Number: 4,660,715

[45] Date of Patent: Apr. 28, 1987

[54] MULTIPLE FUNCTION MAGNETIC UTILITY CUP

[75] Inventor: Arleen R. Anastos, Yorktown Heights, N.Y.

[73] Assignee: Arjon Mfg. Corporation, Hillside, N.J.

[21] Appl. No.: 796,210

[22] Filed: Nov. 4, 1985

[51] Int. Cl.[4] ..... A07F 5/08

[52] U.S. Cl. ..... 206/0.8; 206/0.81; 206/223; 206/806; 206/818; 211/13; 211/88; 248/206.5; 248/304

[58] Field of Search ..... 206/0.8, 0.81, 231, 206/806, 818, 223; 211/DIG. 1, 13, 88; 248/206.5, 304

[56] References Cited

U.S. PATENT DOCUMENTS

| | | | |
|---|---|---|---|
| 1,381,343 | 6/1921 | Sampson | 206/0.8 |
| 1,798,768 | 3/1931 | Vance | 248/304 |
| 2,756,895 | 7/1956 | Ehders | 206/818 |
| 2,862,626 | 12/1958 | Clare | 211/88 |
| 3,113,996 | 12/1963 | Sanford | 211/88 |
| 3,514,064 | 5/1970 | Katz | 211/88 |
| 3,556,341 | 1/1971 | Rains | 206/818 |
| 3,642,122 | 2/1972 | Von Ende | 206/818 |
| 4,100,684 | 7/1978 | Berger | 206/818 |
| 4,124,189 | 11/1978 | Einhorn | 248/304 |
| 4,233,911 | 11/1980 | Vignale | 211/88 |

FOREIGN PATENT DOCUMENTS

| | | | |
|---|---|---|---|
| 1159022 | 2/1958 | France | 206/818 |

*Primary Examiner*—William Price
*Assistant Examiner*—Brenda J. Ehrhardt
*Attorney, Agent, or Firm*—Marvin Feldman

[57] ABSTRACT

A plastic utility cup is provided with a magnet on the rear wall and a hook is selectively connected to the rear wall and depends from the bottom of the cup forwardly to the forward wall, whereby with the cup magnetically held to a refrigerator door, items may be hung from the hook, while other items may be held in the cup, and papers held between the magnet and the door. A cover may be provided with the cup, which cover may be slotted for coins and the like.

8 Claims, 4 Drawing Figures

MULTIPLE FUNCTION MAGNETIC UTILITY CUP

FIELD OF THE INVENTION

This invention relates to a utility cup. More specially this invention relates to multiple function utility cups.

BACKGROUND AND DISCUSSION OF THE PRIOR ART

Heretofore it was known to provide a utility cup for mounting to a wall for holding items.

It was also known in the art to affixedly mount hooks to a wall.

It was known in the art directed to kitchen housewares to provide decorative magnets for magnetically mounting to a refrigerator door for holding note papers to the refrigerator door.

The kitchen housewares directed prior art desired an item which would have selective multiple functions and yet be readily and inexpensively manufactured.

It is therefore a principal object of the present invention to provide a kitchen magnet utility cup having multiple functions.

It is another object of the present invention to provide a cup and mold as aforesaid, wherein a multiple function cover is selectively provided as well.

It is still a further object of the present invention to provide a kitchen magnet item as aforesaid which is practical in design and function, and is readily useful for its intended functions, and yet is safe and practical in use.

SUMMARY OF THE INVENTION

A cup is formed with a rear wall, a forward wall and a bottom wall, with a magnet affixed to and within a recess in the rear wall, and in one aspect a hook is connected to the rear wall and depends from the bottom wall outwardly towards the forward wall. A cover is provided as well. The cup is magnetically mounted to the door of a kitchen refrigerator where diverse items may be held in the cup and hung from the hook, while note papers may be held by the magnet against the door.

DESCRIPTION OF THE PREFERRED EMBODIMENTS

Figure 1:
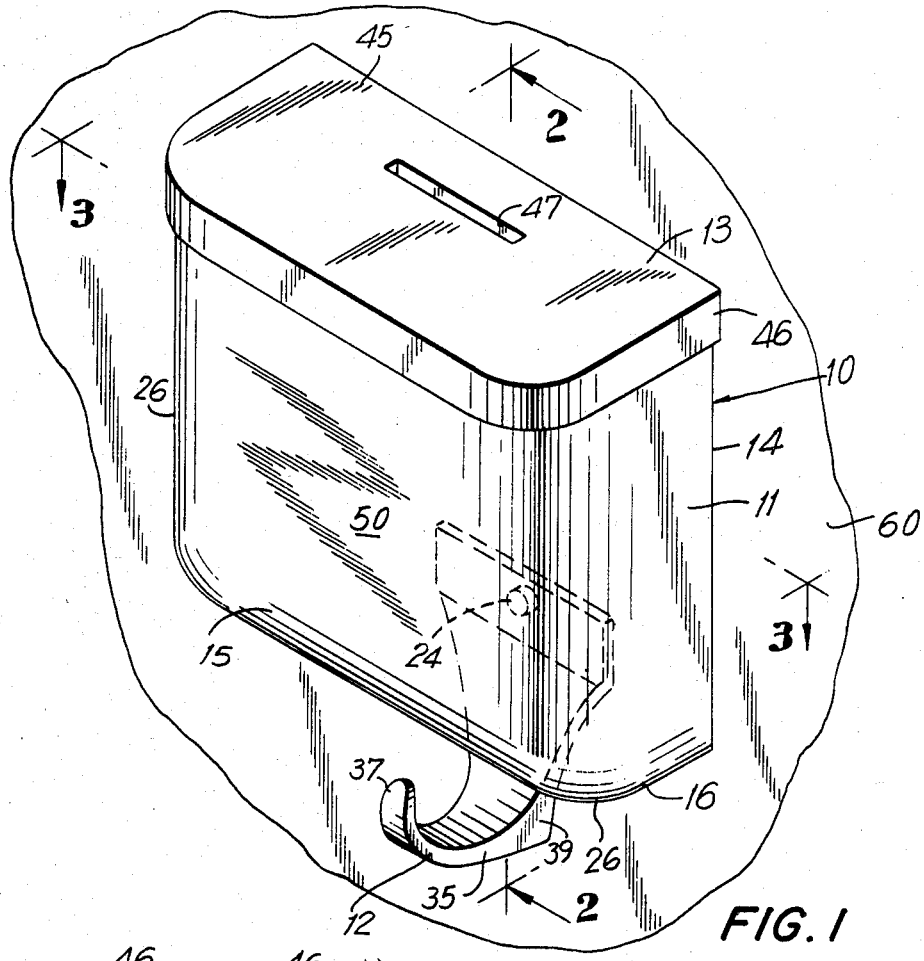
FIG. 1 is a front perspective view of the cup of the present invention.
Figure 2:
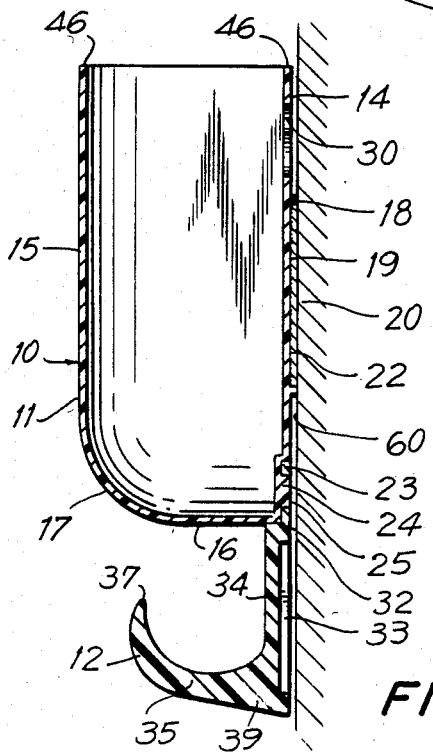
FIG. 2 is a sectional view of the cup taken along line 2—2 of FIG. 1 without the cover.
Figure 3:
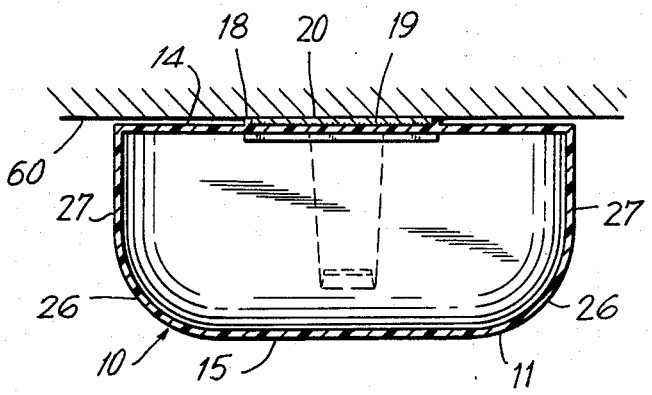
FIG. 3 is a sectional view taken along line 3—3 of FIG. 1.
Figure 4:
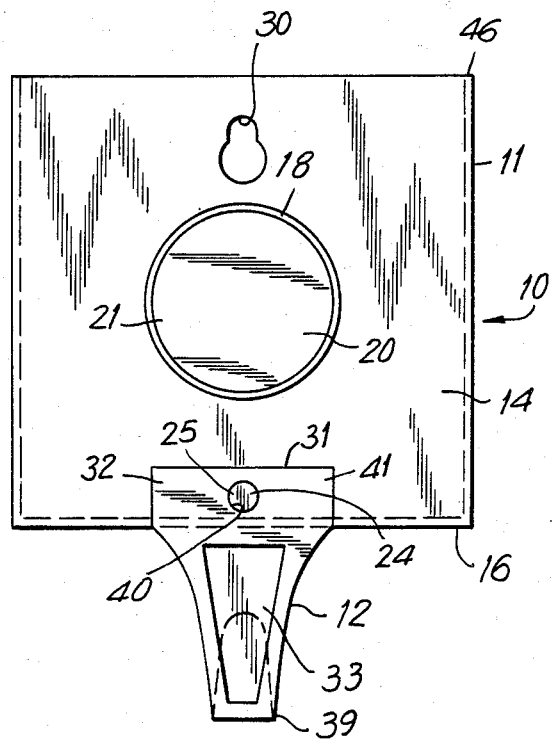
FIG. 4 is a rear view of the cup of FIG. 1 without the cover.

Referring to the FIGURES, there is shown the utility cup of the present invention generally referred to as 10. Cup 10, in general terms, is formed of two parts, namely cup or cup portion 11 and hook 12. Additionally, a cover 13 may be provided.

Cup 11 is formed with a rear wall 14, a foreward or front wall 15, and a bottom wall 16 having a rounded portion 17 which is contiguous with front wall 15. Curved foreward wall portions 26 connect wall 15 to side walls 27. Rear wall 14 is formed with a circular lip 18 forming recess 19 for receiving cylindrical magnet 20. Face 21 of magnet 20 may be adhesively secured at wall portion 22 to affix magnet 20 to cup 11.

Rear wall 14 is also formed with recess 23. A cylindrical member 24 extends outwardly rearwardly from recess 23, so that the end face 25 is coplanar with rear wall 14, for purposes hereinafter appearing.

A curvilinear slot or opening 30 is formed in wall 14 for alternatively mounting cup 11 to a screw or hook (not shown).

Hook 12 is formed with a top edge 31, a rear wall 32 having trapezoidal-shaped recess 33, a foreward or front wall 34 which is parallel to rear wall 32 and a hook portion 35, which extends forewardly from walls 32 and 34. Hook portion 35 is tapered so that free end portion 37 is substantially narrower than wall-connected portion 39. A circular through hole 40 is formed in the upper wall portion 41, and hole 40 is sized to permit a snap-fit onto member 24 whereby hook wall portion 41 fits snugly into recess 23. With the hook 12 connected to cup 11, hook portion rear wall 32 is coplanar with cup rear wall 14 so as to provide a flush fit.

Cover 13 is formed with a top wall 45 and a depending lip 46 which contours the periphery of wall 45 and contours the top edge 46 of cup 11 so that cover 13 rests on edge 46 of cup 11. A rectilinear slot 49 is formed in wall 45 for purposes hereinafter appearing.

In operation hook 12 is snap-fitted onto cup 11, and the assemblage is magnetically mounted to a ferro-metal refrigerator door 60. Note paper and the like (not shown) may be held between the cup magnet 20 and the metal door 60. Items (not shown) may then be held or hung by hook portion 35 while other items (not shown) may be held within cup 11. Cover 13 may hold the items in the cup, and slot 47 may serve to receive coins and the like.

The front face 50 of cup front wall 15 may be provided with indicia regarding the intended usage of the cup, such as for corn cob picks, paper clips, candles, coins and the like.

While the afore-discussed related to certain embodiments of the inventions, various modifications are also within the contemplation of the invention. For example, a magnet may be affixedly inserted within the trapezoidal recess of the hook to provide improved mounting of the cup and hook assembly.

What is claimed is:

1. A utility cup comprising: a cup having a rear wall, a forward wall and a bottom wall, and wherein the rear wall is formed with a flat portion, a magnet, and means for retaining said magnet in said rear wall flat portion, so that the cup is magnetically secured to a ferro-metal surface, and a hook, said cup including further comprising means for disconnectably connecting said hook, and said hook including means for disconnectably connecting said hook to said cup, said hook means for connecting said hook comprising a flange extending upwardly from the hook, said flange comprising a rear wall flat portion, and with said hook connected to said cup said flange in disposed between the cup and the ferro-metal surface with the hook rear wall flat portion flush with the cup rear wall flat portion, so that the hook is adjacent to and extends downwardly from the bottom wall and forwardly of said rear wall flat portions.

2. The utility cup of claim 1, said magnet being cylindrical, and said retaining means further comprising said flat portion being formed with a circular lip for receiving said magnet.

3. The utility cup of claim 2, further comprising a cover, said cover being shaped so as to rest on the top of said cup.

4. The utility cup of claim 3, said cover being formed with a slot.

5. The utility cup of claim 2, said cup and hook each being formed of plastic.

6. The utility cup of claim 5, said forward wall being formed with a flat portion, said flat portions being in parallel disposition.

7. The utility cup of claim 6, said retaining means comprising adhesive means for holding said magnet in said lip.

8. The utility cup of claim 1, said cup means for connecting said hook to the cup comprising a plastic pin extending rearwardly from the cup, and said hook means for connecting said hook to said cup comprising said flange being formed with a through hole so that said plastic pin snap-fits into said through hole.

* * * * *